US008230693B2

(12) United States Patent
Tsuji et al.

(10) Patent No.: US 8,230,693 B2
(45) Date of Patent: Jul. 31, 2012

(54) INTERIOR PANEL OF AIR CONDITIONER AND AIR CONDITIONER

(75) Inventors: Kaichi Tsuji, Osaka (JP); Tomohiro Yabu, Osaka (JP); Tetsuya Morizane, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 510 days.

(21) Appl. No.: 12/083,925

(22) PCT Filed: Oct. 24, 2006

(86) PCT No.: PCT/JP2006/321153

§ 371 (c)(1),
(2), (4) Date: Apr. 21, 2008

(87) PCT Pub. No.: WO2007/055098

PCT Pub. Date: May 18, 2007

(65) Prior Publication Data

US 2009/0241576 A1 Oct. 1, 2009

(30) Foreign Application Priority Data

Nov. 11, 2005 (JP) ..... 2005-327875
Mar. 10, 2006 (JP) ..... 2006-066399

(51) Int. Cl.
*F25D 23/12* (2006.01)
*F25D 17/04* (2006.01)
*F25D 17/06* (2006.01)
*F24F 13/08* (2006.01)

(52) U.S. Cl. ..... 62/262; 62/263; 62/408; 62/426; 454/322

(58) Field of Classification Search ..... 62/262, 62/263, 407, 408, 426, 427; 454/322–327
See application file for complete search history.

(56) References Cited

U.S. PATENT DOCUMENTS 5,461,875 A * 10/1995 Lee et al. ..... 62/89
5,807,170 A 9/1998 Lee
5,857,343 A 1/1999 Cho et al.
5,888,133 A * 3/1999 Mori et al. ..... 454/318
6,089,972 A * 7/2000 Gunji et al. ..... 454/233
6,196,018 B1 * 3/2001 Mori et al. ..... 62/404
6,264,552 B1 * 7/2001 Oya et al. ..... 454/304
6,739,969 B2 * 5/2004 Shin ..... 454/155
6,921,329 B2 * 7/2005 Riello ..... 454/318

(Continued)

FOREIGN PATENT DOCUMENTS

CN 1158402 A 9/1997

(Continued)

*Primary Examiner* — Marc Norman
(74) *Attorney, Agent, or Firm* — Birch, Stewart, Kolasch & Birch, LLP.

(57) ABSTRACT

In order to give a simple appearance design to an interior panel (10) for an air conditioner (1) of the type having a couple of juxtaposed air inlet (11) and air outlet (12) and to eliminate the need for a complicated mechanism or behavior for implementing the design, the interior panel (10) is provided with: an opening cover (15) covering the couple of air inlet (11) and air outlet (12) together; and an opening/closing mechanism for opening and closing the couple of air inlet (11) and air outlet (12) by changing the position of the opening cover (15) within a region including the couple of air inlet (11) and air outlet (12). The opening/closing mechanism is a mechanism for turning the opening cover (15) about a central axis (O) located between the couple of air inlet (11) and air outlet (12).

10 Claims, 12 Drawing Sheets

U.S. PATENT DOCUMENTS

| | | | |
|---|---|---|---|
| 7,703,294 | B2 | 4/2010 | Nakamura |
| 7,716,944 | B2 | 5/2010 | Murai |
| 2006/0218957 | A1 | 10/2006 | Nakamura |

FOREIGN PATENT DOCUMENTS

| | | | |
|---|---|---|---|
| EP | 1382917 | A1 | 1/2004 |
| JP | 55-57609 | U | 4/1980 |
| JP | 1-60122 | U | 4/1989 |
| JP | 4-20923 | U | 2/1992 |
| JP | 8-240337 | A | 9/1996 |
| JP | 9-33062 | A | 2/1997 |
| JP | 2988329 | B2 | 10/1999 |
| JP | 2000-39172 | A | 2/2000 |
| JP | 2000-205642 | A | 7/2000 |
| JP | 2001-90981 | A | 4/2001 |
| JP | 2004-293887 | A | 10/2004 |
| JP | 2005-98671 | A | 4/2005 |
| JP | 2005-98684 | A | 4/2005 |
| JP | 2005-98686 | A | 4/2005 |
| JP | 2005-299975 | A | 10/2005 |

* cited by examiner

INTERIOR PANEL OF AIR CONDITIONER AND AIR CONDITIONER

TECHNICAL FIELD

This invention relates to interior panels for air conditioners and air conditioners with an interior panel and particularly relates to an interior panel of the type having a couple of juxtaposed air inlet and air outlet and an air conditioner therewith.

BACKGROUND ART

For example, known ceiling-mounted air conditioners include the type that each of both long-side lateral ends of a rectangular interior panel has a couple of air inlet and air outlet juxtaposed to each other (see, for example, Patent Document 1). The interior panel of the air conditioner of this type is formed to bring a rectangular frame and a flat center plate into flush with each other. Four elongated openings are disposed between the frame and the center plate, two in each of both long-side lateral ends of the interior panel. Out of these openings, two located towards the center of the panel are air inlets and two located towards the outside of the panel are air outlets.

Patent Document 1: Japanese Patent Publication No. 2988329

DISCLOSURE OF THE INVENTION

Problems to be Solved by the Invention

However, since in the known air conditioner each of both long-side lateral ends of the interior panel has two openings (an air inlet and an air outlet), the openings impair the simplicity of design despite that the room-side surfaces of the frame and the center plate are flush with each other to provide a sense of unity.

Furthermore, it is conceivable that the air conditioner includes opening covers covering each of air inlets and air outlets when it is stopped. In this case, however, there may be needed a complicated mechanism or complicated behavior for opening and closing the openings.

The present invention has been made in view of the foregoing points and, therefore, an object of the present invention is to give a simple appearance design to an interior panel for an air conditioner of the type having a couple of juxtaposed air inlet and air outlet and concurrently eliminate the need for a complicated mechanism or behavior for implementing the design.

Means to Solve the Problems

A first aspect of the invention is directed to an interior panel (10) of an air conditioner (1) in which the surface of the interior panel (10) has a couple of juxtaposed air inlet (11) and air outlet (12).

Furthermore, as a feature of this aspect of the invention, the interior panel (10) is provided with: an opening cover (15) covering the couple of air inlet (11) and air outlet (12) together; and an opening/closing mechanism (30) for opening and closing the couple of air inlet (11) and air outlet (12) by changing the position of the opening cover (15) within a region including the couple of air inlet (11) and air outlet (12).

In the first aspect of the invention, when the air conditioner (1) is stopped, the opening cover (15) covers both the air inlet (11) and the air outlet (12) juxtaposed to each other in the surface of the interior panel (10). At this time, the surface of the interior panel (10) becomes flat. Furthermore, in this aspect of the invention, the couple of air inlet (11) and air outlet (12) can be opened and closed simply by changing the position of the opening cover (15) within the region including the couple of air inlet (11) and air outlet (12).

A second aspect of the invention is the interior panel of the air conditioner (1) according to the first aspect of the invention, wherein the opening/closing mechanism (30) is a mechanism for turning the opening cover (15) about a central axis (O) located between the couple of air inlet (11) and air outlet (12).

In the second aspect of the invention, when the air conditioner (1) is in operation, the couple of air inlet (11) and air outlet (12) can be opened by turning the opening cover (15), which has covered the couple of air inlet (11) and air outlet (12) during shutdown of the air conditioner (1), about the central axis (O) between the couple of air inlet (11) and air outlet (12).

A third aspect of the invention is the interior panel of the air conditioner (1) according to the second aspect of the invention, wherein the interior panel is provided with a fixed member (18) disposed inwardly of the panel surface, and the opening/closing mechanism (30) includes a drive motor (31) fixed to the fixed member (18), a drive gear (32) fixed to the drive motor (31), and a driven gear (34) mounted to the opening cover (15) and mated with the drive gear (32).

In the third aspect of the invention, the rotation of the drive gear (32) is transmitted to the driven gear (34) by activating the drive motor (31). Furthermore, when the driven gear (34) is rotated, the opening cover (15) turns. During the time, the rotation of the drive motor (31) is controlled forward or backward, whereby the opening cover (15) can be opened or closed.

A fourth aspect of the invention is the interior panel of the air conditioner (1) according to the third aspect of the invention, wherein the surface of the interior panel has a plurality of couples of juxtaposed air inlet (11) and air outlet (12) openings formed at different points and provided with their respective opening covers (15), and the opening/closing mechanism (30) includes a power transmission mechanism (35) for transmitting power of one said drive motor (31) to a plurality of said opening covers (15). The term "a plurality of said opening covers (15)" here may be all the opening covers (15) in the air conditioner or may be some of all the opening covers (15). For example, all the opening covers (15) in the air conditioner may be driven by a single drive motor (31). Alternatively, if the air conditioner includes four opening covers (15) and two drive motors (31), the four opening covers (15) may be driven two by each drive motor (31). In other words, in this aspect of the invention, the number of drive motors (31) in the air conditioner is not limited to one and may be two or more so long as each drive motor (31) drives a plurality of opening covers (15).

In the fourth aspect of the invention, when one drive motor (31) is activated, a plurality of opening covers (15) associated with the drive motor (31) can be concurrently opened or closed to set them into an open position during operation or a closed position during shutdown.

A fifth aspect of the invention is the interior panel of the air conditioner (1) according to the second aspect of the invention, wherein the opening cover (15) is configured to serve as a partition member between the couple of air inlet (11) and air outlet (12) when the opening cover (15) is open.

In the fifth aspect of the invention, when the opening cover (15) is opened, it functions as a partition member between the couple of air inlet (11) and air outlet (12). In other words, the couple of air inlet (11) and air outlet (12) are not separated from each other until the opening cover (15) is opened.

A sixth aspect of the invention is the interior panel of the air conditioner (1) according to the second aspect of the invention, wherein the interior panel is provided with a sliding mechanism (27) that, with the opening cover (15) open, slides the opening cover (15) in a direction orthogonal to the panel surface so that the distal end of the opening cover (15) is substantially flush with the panel surface.

In the sixth aspect of the invention, when the air conditioner (1) is in operation, the opening cover (15) can be accommodated in an open position within the casing (20) without extending beyond the panel surface.

A seventh aspect of the invention is the interior panel of the air conditioner (1) according to the second aspect of the invention, wherein the opening/closing mechanism (30) is configured to allow the opening cover (15) to turn within a predetermined range of angles with respect to a closed position of the opening cover (15).

In the seventh aspect of the invention, the opening cover (15) need not turn to the angle orthogonal to the panel surface. The angle θ to which the opening cover (15) turns is, for example, 30° or more. The angle θ may be about 45° at maximum or about 60° at maximum.

An eighth aspect of the invention is the interior panel of the air conditioner (1) according to any one of the first to seventh aspects of the invention, wherein one pair of opposed ends of the panel surface of substantially quadrangular shape have their respective couples of juxtaposed air inlet (11) and air outlet (12) openings.

In the eighth aspect of the invention, when the opening cover (15) is opened, a couple of juxtaposed air inlet (11) and air outlet (12) appear in each of the one pair of opposed ends of the panel surface of substantially quadrangular shape. Therefore, air intake and air supply can be easily carried out in a two-directional air supply type air conditioner (1).

A ninth aspect of the invention is the interior panel of the air conditioner (1) according to any one of the first to seventh aspects of the invention, wherein two pairs of opposed ends of the panel surface of substantially quadrangular shape have their respective couples of juxtaposed air inlet (11) and air outlet (12) openings.

In the ninth aspect of the invention, when the opening cover (15) is opened, a couple of juxtaposed air inlet (11) and air outlet (12) appear in each of the two pairs of opposed ends of the panel surface of substantially quadrangular shape. Therefore, air intake and air supply can be easily carried out in a four-directional air supply type air conditioner (1).

A tenth aspect of the invention is the interior panel of the air conditioner (1) according to any one of the first to ninth aspects of the invention, wherein the air outlet (12) is provided with a wind direction control flap (40) for controlling the angle of air supply with respect to the panel surface, and the wind direction control flap (40) is split into a plurality of sections along the longitudinal direction of the air outlet (12).

In the tenth aspect of the invention, when the opening cover (15) is open, the air supply direction can be finely controlled by individually controlling the directions of the plurality of sections of the wind direction control flap (40) disposed in the air outlet (12).

An eleventh aspect of the invention is directed to an air conditioner (1) in which an interior panel (10) is fitted to an opening of a casing (20), and has a feature that the interior panel (10) comprises the interior panel (10) according to any one of the first to tenth aspects of the invention.

In the eleventh aspect of the invention, when the air conditioner (1) with the interior panel (10) is stopped, the opening cover (15) covers both the air inlet (11) and the air outlet (12) juxtaposed to each other in the surface of the interior panel (10). At this time, the surface of the interior panel (10) becomes flat. Furthermore, the couple of air inlet (11) and air outlet (12) can be opened and closed simply by changing the position of the opening cover (15) within the region including the couple of air inlet (11) and air outlet (12). Particularly, if the opening/closing mechanism (30) is a mechanism for turning the opening cover (15) about a central axis (O) located between the couple of air inlet (11) and air outlet (12), when the air conditioner (1) is in operation, the air inlet (11) and the air outlet (12) can be easily opened by turning the opening cover (15), which has covered the couple of air inlet (11) and air outlet (12) during shutdown of the air conditioner (1), about the central axis (O) between the couple of air inlet (11) and air outlet (12).

Effects of the Invention

According to the present invention, the couple of air inlet (11) and air outlet (12) can be opened and closed simply by changing the position of the opening cover (15) within the region including the couple of air inlet (11) and air outlet (12). This prevents the need for a complicated mechanism or complicated behavior for opening and closing the openings (i.e., the air inlet (11) and the air outlet (12)). Furthermore, since during shutdown of the air conditioner (1) the opening cover (15) covers the couple of air inlet (11) and air outlet (12) juxtaposed to each other in the surface of the interior panel (10) and the surface of the interior panel (10) becomes flat, the interior panel (10) can have a simple appearance design.

According to the second aspect of the invention, when the air conditioner (1) is in operation, the couple of air inlet (11) and air outlet (12) can be opened by turning the opening cover (15), which has covered the couple of air inlet (11) and air outlet (12) during shutdown of the air conditioner (1), about the central axis (O) between the couple of air inlet (11) and air outlet (12). Therefore, the air inlet (11) and the air outlet (12) can be opened and closed with a particularly simple mechanism and behavior. Furthermore, in the second aspect of the invention, the opening cover (15) serves as a partition plate between the couple of air inlet (11) and air outlet (12). Therefore, if the opening cover (15) is set substantially orthogonally to the ceiling in preparation for heating operation, such as of a ceiling-mounted air conditioner (1) or a ceiling pendant air conditioner (1), this prevents the occurrence of a short circuit that warm air blown out through the air outlet (12) is directly taken through the air inlet (11) into the air conditioner (1). Furthermore, according to this aspect of the invention, since a turning of the opening cover (15) is all that is needed to open and close the air inlet (11) and the air outlet (12), the number of moving parts and the amount of movement are both small, which offers the advantage of less sense of discomfort in design also during operation.

According to the third aspect of the invention, by activating the drive motor (31) forward or backward, the rotation of the drive gear (32) can be transmitted through the driven gear (34) to the opening cover (15) to open or close the opening cover (15). In this manner, according to this aspect of the invention, the opening cover (15) can be opened and closed with a very simple structure and a simple behavior.

According to the fourth aspect of the invention, since there are opening covers (15) at a plurality of points of the panel surface and the power transmission mechanism (35) of the opening/closing mechanism (30) is configured to transmit power of one drive motor (31) to a plurality of opening covers (15), the opening covers (15) at a plurality of points can be concurrently opened and closed by activating the one drive motor (31). According to this aspect of the invention, a single motor suffices to operate all the opening covers (15) (or the number of drive motors (31) can be smaller than the number of opening covers (15)), which further simplifies the mechanism. Furthermore, with the use of two drive motors (31), each motor can be downsized as compared with the use of a single drive motor.

According to the fifth aspect of the invention, since the couple of air inlet (11) and air outlet (12) are not separated from each other until the opening cover (15) is opened, the structure of the casing (20) can be simplified. Furthermore, since there is no need for a special member for separating the air inlet (11) from the air outlet (12), this provides reduced cost and reduced weight as compared with the provision of such a special member.

According to the sixth aspect of the invention, since the interior panel is provided with a sliding mechanism (27) that, with the opening cover (15) open, slides the opening cover (15) in a direction orthogonal to the panel surface so that the distal end of the opening cover (15) is substantially flush with the panel surface, the opening cover (15) can be accommodated within the casing (20) without extending beyond the panel surface during operation of the air conditioner (1). Therefore, the air conditioner (1) can have a simple design not only when it is stopped but also when it is in operation. Furthermore, even if the inside surface of the opening cover (15) is filled with brush fibers or subjected to any other measure for dew condensation prevention, this does not impair the design because the opening cover (15) does not extend beyond the panel surface.

According to the seventh aspect of the invention, the opening cover (15) need not turn to the angle orthogonal to the panel surface. The angle θ to which the opening cover (15) turns is, for example, 30° or more. Thus, the ceiling can be prevented from being stained. The angle θ may be about 45° at maximum or about 60° at maximum. Since, thus, the opening/closing mechanism (30) is configured to allow the opening cover (15) to turn from the closed position within a predetermined range of angles, the user can select a desired angle of air supply.

According to the eighth aspect of the invention, since a couple of juxtaposed air inlet (11) and air outlet (12) appear in each of one pair of opposed ends of the panel surface of substantially quadrangular shape by opening the opening cover (15), air intake and air supply can be easily carried out in a two-directional air supply type air conditioner (1). Therefore, also in this aspect of the invention, the structure and behavior can be prevented from being complicated.

According to the ninth aspect of the invention, a couple of juxtaposed air inlet (11) and air outlet (12) appear in each of two pairs of opposed ends of the panel surface of substantially quadrangular shape by opening the opening cover (15), air intake and air supply can be easily carried out in a four-directional air supply type air conditioner (1). Therefore, also in this aspect of the invention, the structure and behavior can be prevented from being complicated.

According to the tenth aspect of the invention, since the wind direction control flap (40) disposed in the air outlet (12) is split into a plurality of sections along the longitudinal direction of the air outlet (12), the air supply direction can be finely controlled, with the opening cover (15) open, by individually controlling the directions of the plurality of sections of the wind direction control flap (40) disposed in the air outlet (12).

According to the eleventh aspect of the invention, like the first to tenth aspects of the invention, the couple of air inlet (11) and air outlet (12) can be opened and closed simply by changing the position of the opening cover (15) within the region including the couple of air inlet (11) and air outlet (12). This prevents the need for a complicated mechanism or complicated behavior for opening and closing the openings (i.e., the air inlet (11) and the air outlet (12)). Furthermore, since during shutdown of the air conditioner (1) the opening cover (15) covers the couple of air inlet (11) and air outlet (12) juxtaposed to each other in the surface of the interior panel (10) and the surface of the interior panel (10) becomes flat, the interior panel (10) of the air conditioner (1) can have a simple appearance design.

Furthermore, if the air conditioner (1) is configured so that when the air conditioner (1) is in operation, the opening cover (15), which has covered the couple of air inlet (11) and air outlet (12) during shutdown of the air conditioner (1), is turned about the central axis (O) between the couple of air inlet (11) and air outlet (12), the air inlet (11) and the air outlet (12) can be opened and closed with a particularly simple mechanism and behavior.

BRIEF DESCRIPTION OF DRAWINGS

FIG. 1 is a perspective view of an air conditioner according to Embodiment 1 as viewed from below when it is in operation.

FIG. 2 is a perspective view of the air conditioner of FIG. 1 as viewed from below when it is stopped.

FIG. 3 is a bottom view of an interior panel when an opening cover is removed therefrom.

FIG. 4 is a cross-sectional view of the air conditioner taken along the line IV-IV of FIG. 3.

FIG. 5 is a cross-sectional view of the air conditioner taken along the line V-V of FIG. 3.

FIG. 6 is a perspective view of an air conditioner according to Modification 1 of Embodiment 1 as viewed from below when it is in operation.

FIG. 7 is a cross-sectional view of an air conditioner according to Modification 2 of Embodiment 1.

FIG. 8 is a perspective view of the air conditioner according to Modification 2 of Embodiment 1 as viewed from below.

FIG. 9 is a cross-sectional view of an air conditioner according to Modification 3 of Embodiment 1.

FIG. 10 is a cross-sectional view of an air conditioner according to Modification 4 of Embodiment 1.

FIG. 11 is a perspective view of an air conditioner according to Embodiment 2 as viewed from below when it is in operation.

FIG. 12 is a perspective view of the air conditioner of FIG. 11 as viewed from below when it is stopped.

FIG. 13 is a perspective view of an air conditioner according to Modification 1 of Embodiment 2 as viewed from the front when it is in operation.

FIG. 14 is a perspective view of the air conditioner of FIG. 13 as viewed from the front when it is stopped.

FIG. 15 is a perspective view of an air conditioner according to Modification 2 of Embodiment 2 as viewed from the front when it is in operation.

FIG. 16 is a perspective view of the air conditioner of FIG. 14 as viewed from the front when it is stopped.

LIST OF REFERENCE NUMERALS

Figure 1:
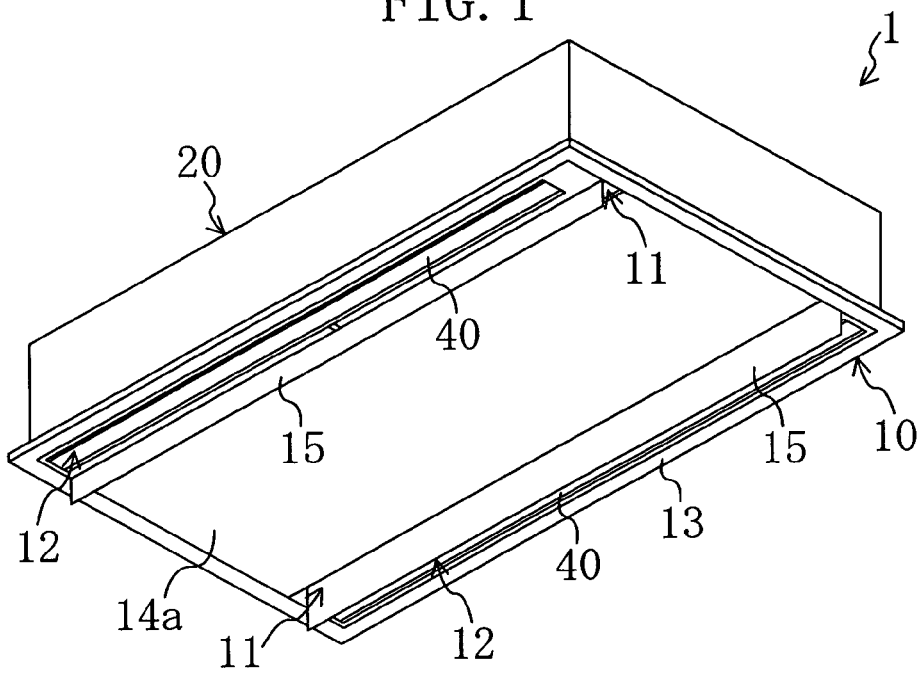
[FIG. 1]

1 air conditioner
10 interior panel
11 air inlet

12 air outlet
15 opening cover
18 fixed member
20 casing
30 opening/closing mechanism
31 drive motor
32 drive gear
34 driven gear
35 power transmission mechanism
40 wind direction control flap

BEST MODE FOR CARRYING OUT THE INVENTION

Embodiments of the present invention will be described below in detail with reference to the drawings.

<<Embodiment 1 of the Invention>>

A description is given of Embodiment 1 of the invention.

Figure 2:
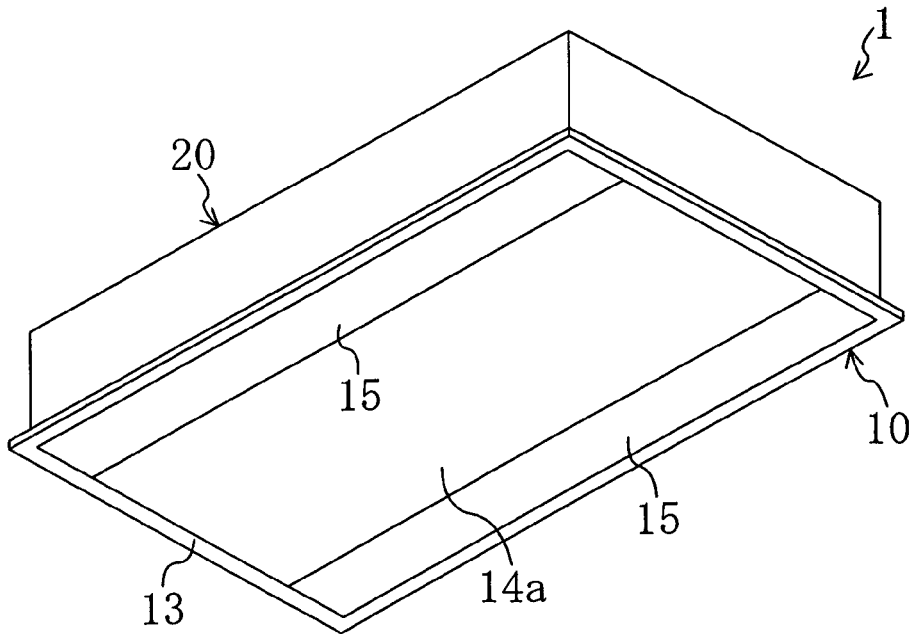
[FIG. 2]

FIG. 1 is a perspective view of an air conditioner (1) with an interior panel (10) according to the present invention as viewed from below when it is in operation, and FIG. 2 is a perspective view of the air conditioner (1) of FIG. 1 as viewed from below when it is stopped. As shown in these figures, the air conditioner (1) includes a casing (20) and an interior panel (10) fitted to the bottom of the casing (20).

The interior panel (10) is formed generally in a rectangular shape and, as shown in FIG. 1, each of both long-side lateral ends thereof has a couple of air inlet (11) and air outlet (12) juxtaposed to each other. The interior panel (10) includes a rectangular frame (13) and a flat center plate (14*a*) and is configured so that the room-side surfaces of the frame (13) and the center plate (14*a*) are flush with each other. Four elongated openings (11, 12) are disposed as spaces between the frame (13) and the center plate (14*a*), two in each of both lateral ends of the interior panel (10). Out of these openings (11, 12), two located towards the center of the interior panel (10) are air inlets (11) and two located towards the outside of the interior panel (10) are air outlets (12).

Both the lateral ends of the interior panel (10) have their respective opening covers (15) each covering the associated couple of air inlet (11) and air outlet (12) together. Each opening cover (15) is configured to be changeable in position between an open position shown in FIG. 1 and a closed position shown in FIG. 2 within a region including the associated couple of air inlet (11) and air outlet (12), and to be thus capable of opening and closing the associated couple of air inlet and air outlet.

Figure 3:
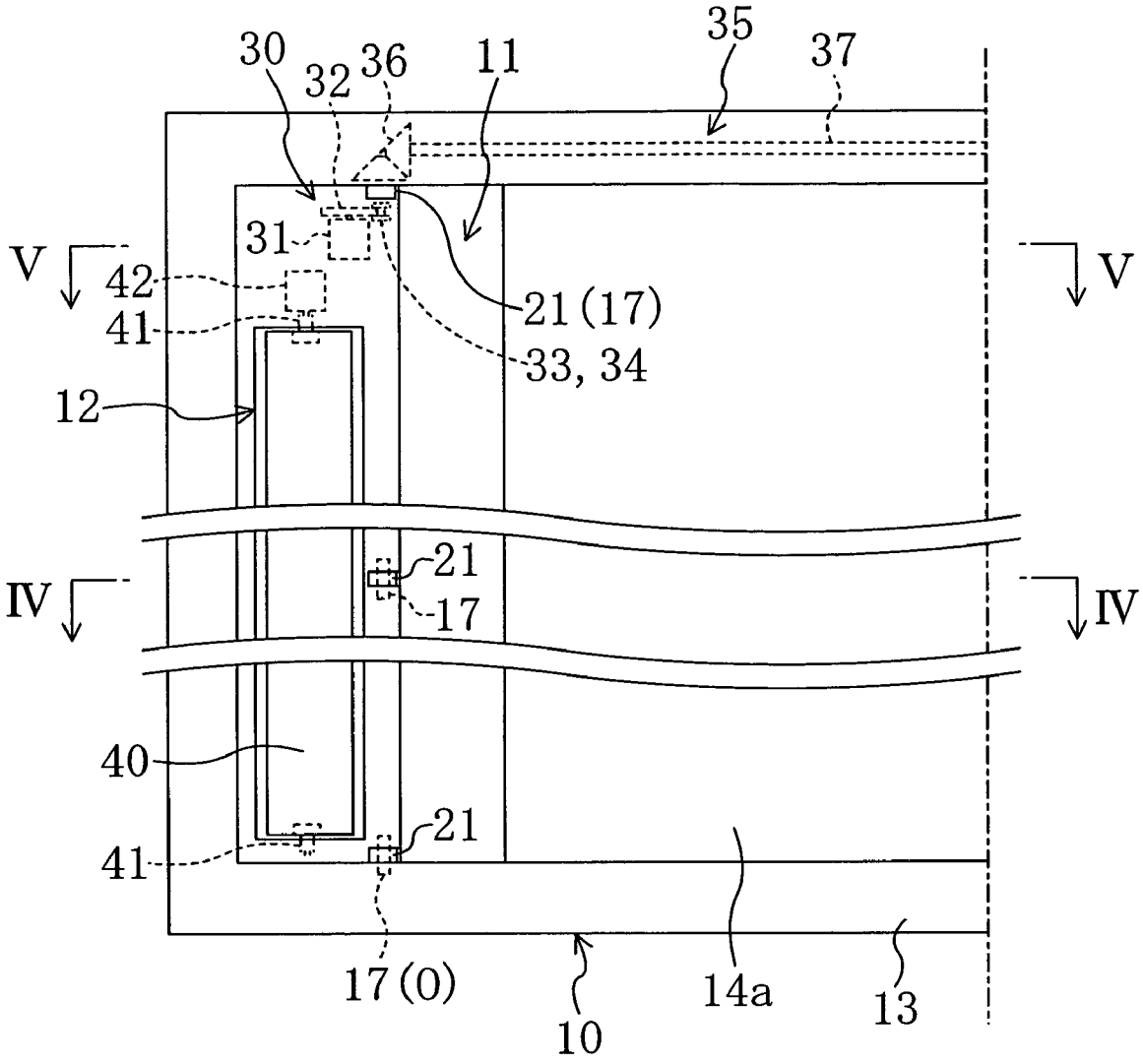
[FIG. 3]
Figure 4:
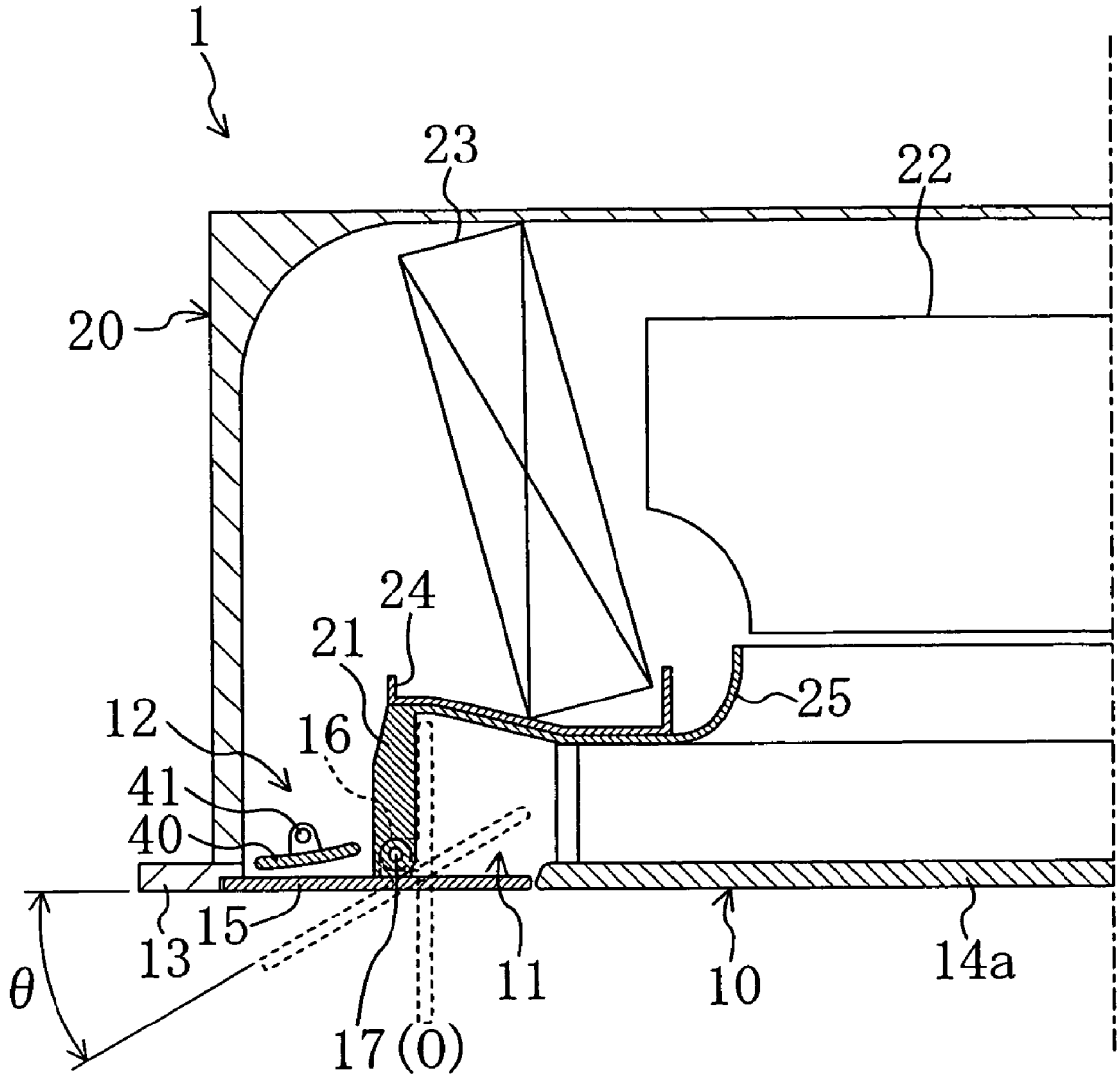
[FIG. 4]
Figure 5:
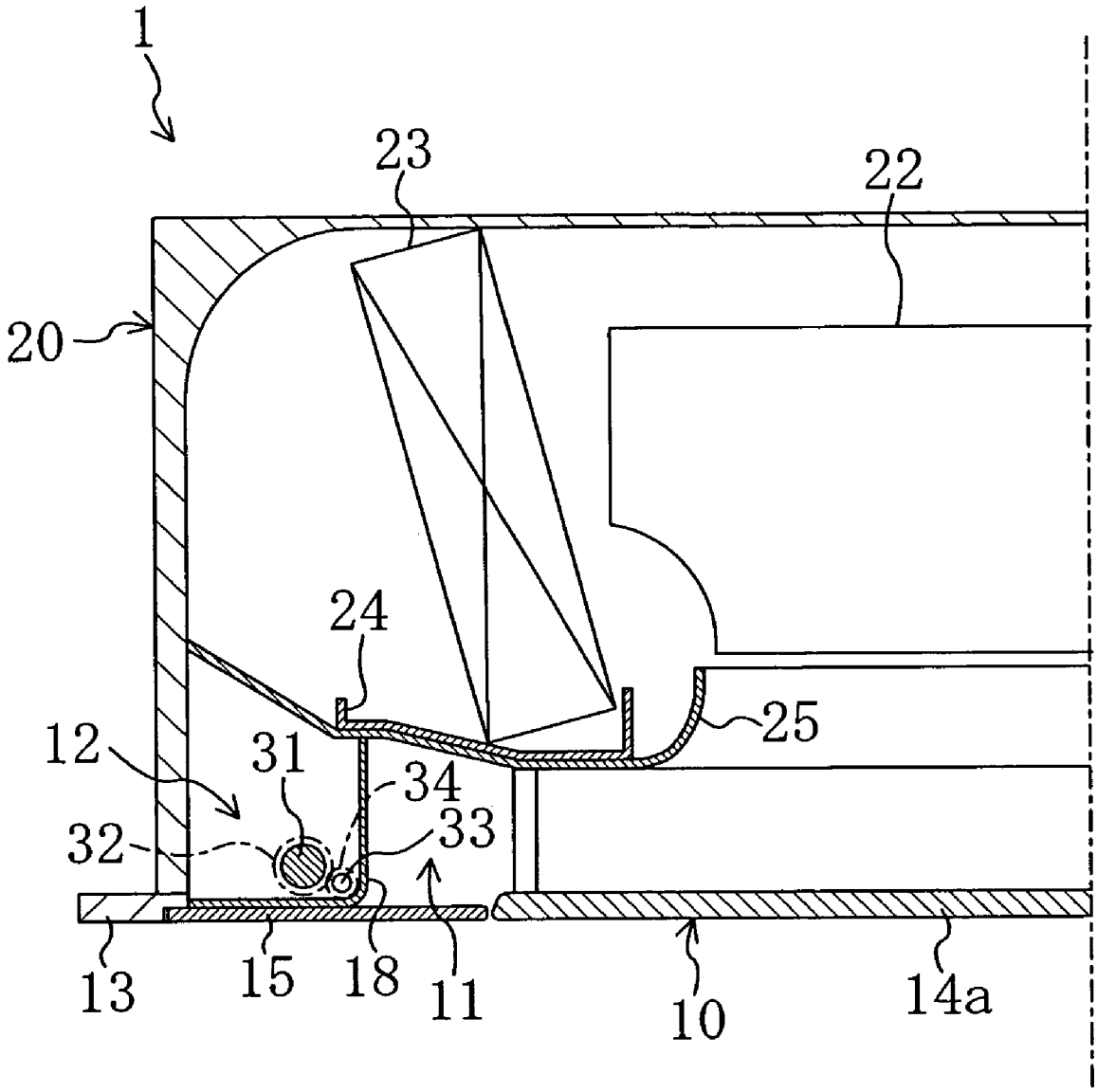
[FIG. 5]

FIG. 3 is a bottom view (partly cross-sectional bottom view) of the interior panel (10) when the opening cover (15) is removed therefrom, FIG. 4 is a cross-sectional view of the air conditioner (1) taken along the line IV-IV of FIG. 3, and FIG. 5 is a cross-sectional view of the air conditioner (1) taken along the line V-V of FIG. 3. FIGS. 4 and 5 show the left half of a longitudinal cross section of the air conditioner (1).

The casing (20) is a rectangular box-shaped member placed above the ceiling (not shown) and its bottom is open. The interior panel (10) is configured to be fitted to the bottom opening of the casing (20) from the room side.

Each opening cover (15) is configured to turn about a central axis (O) located between the associated couple of air inlet (11) and air outlet (12). As shown in FIG. 3, the central axis (O) includes three points in the air outlet (12) (where one point is not given). Specifically, as shown in FIG. 4, three support members (21) are disposed one at each of three points in each air outlet (12) towards the casing (20) and three connecting parts (16) are disposed one at each of three points in the air outlet (12) towards the opening cover (15). Each paired support member (21) and connecting part (16) are connected by a connecting pin (17). When closed as shown in the solid lines of FIG. 4, the opening cover (15) is flush at its room-side surface with the frame (13) and the center plate (14*a*). On the other hand, when open as shown in the broken lines of FIG. 4, the opening cover (15) is located between the frame (13) and the center plate (14*a*) to take a position substantially orthogonal to the frame (13) and the center plate (14*a*). In the latter position, the opening cover (15) serves as a partition member between the couple of air inlet (11) and air outlet (12). In other words, the couple of air inlet (11) and air outlet (12) are separated from each other by opening the opening cover (15).

The casing (20) is provided with an opening/closing mechanism (30) for opening and closing the couples of air inlet (11) and air outlet (12) openings by turning their respective opening covers (15) about the associated connecting pins (17) as central axes (O). The opening/closing mechanism (30) includes a drive motor (31) fixed to a fixed member (18) (see FIG. 5) disposed towards the interior panel (10), a drive gear (32) fixed to the drive motor (31), and a driven gear (34) disposed on a pin (33) fixed to one of the opening covers (15) and mated with the drive gear (32). Furthermore, in order to open and close both the opening covers (15) provided at both the lateral ends of the panel surface with the single drive motor (31), a power transmission mechanism (35) is provided for transmitting power of the single drive motor (31) to both the opening covers (15). The power transmission mechanism (35) is composed of a gear mechanism using bevel gears (36) and an intermediate shaft (37).

Each air outlet (12) is provided with a wind direction control flap (40) (horizontal flap) for controlling the angle of air supply with respect to the panel surface. The wind direction control flap (40) is disposed to be capable of controlling its pivotal shaft (41) to change the angle. The wind direction control flap (40) is connected to a wind direction control motor (42). By controlling the wind direction control motor (42), the control on the air supply direction by the wind direction control flap (40) can be implemented.

In the casing (20), a centrifugal fan (22) is placed above the center plate (14*a*) of the interior panel (10). An indoor heat exchanger (23) is disposed to either side of the centrifugal fan (22) (towards each air outlet (12)). These indoor heat exchangers (23) are connected via refrigerant pipes to a compressor and an outdoor heat exchanger that are provided in an unshown outdoor unit, and allow refrigerant to flow therethrough. During cooling of the room, the refrigerant takes heat from air passing through the indoor heat exchangers (23) to cool the air. On the other hand, during heating of the room, the refrigerant releases heat to air passing through the indoor heat exchangers (23) to heat the air. In these manners, cooled or heated air is supplied through the air outlets (12) to the room. Furthermore, a drain pan (24) is disposed below each indoor heat exchanger (23) and a bell mouth (25) is disposed between the centrifugal fan (22) and each air inlet (11).

—Operational Behavior—

When the air conditioner (1) is stopped, the outdoor unit and the centrifugal fan (22) stop and the opening covers (15) are closed as shown in FIG. 2. In this case, the room-side surfaces of the frame (13), the center plate (14*a*) and the opening covers (15) of the interior panel (10) are flush with one another, thereby making the entire interior panel (10) flat.

On the other hand, when the air conditioner (1) is in operation, the outdoor unit and the centrifugal fan (22) are driven and the drive motor (31) of the opening/closing mechanism (30) rotates, whereby the opening covers (15) are open as shown in FIG. 1. In this case, in the interior panel (10), the air inlets (11) appear on the insides of both the opening covers (15) and the air outlets (12) appear on the outsides of both the opening covers (15). Furthermore, the wind direction control flaps (40) are controlled in angle by their respective wind direction control motors (42).

Thus, in the casing (20) of the air conditioner (1), room air is taken through the air inlets (11) and then bell mouths (25) into the centrifugal fan (22), is then blown out of the centrifugal fan (22), then passes through the indoor heat exchangers (23) and is thereby cooled or heated. Thereafter, the cooled or heated air is controlled in air supply direction by the wind direction control flaps (40) and then supplied to the room.

—Effects of Embodiment 1—

According to the air conditioner (1) of this embodiment, when the air conditioner (1) is stopped, two openings (i.e., an air inlet (11) and an air outlet (12)) in each of both long-side lateral ends of the interior panel (10) are covered with one opening cover (15), whereby the frame (13), the center plate (14*a*) and the opening covers (15) of the interior panel (10) are flush with one another. Therefore, the air inlets (11) and the air outlets (12) at both the lateral ends of the interior panel (10) do not impair the simplicity of the interior panel (10), which makes the entire interior panel (10) flat to provide a high-impact design. In addition, the air conditioner (1) in use has less sense of discomfort in design. Furthermore, the air inlets (11) and the air outlets (12) appear, during operation of the air conditioner (1), with a simple behavior (single action) of turning the opening covers (15) about the connecting pins (17) as central axes (O) and the opening/closing mechanism (30) for opening and closing the opening covers (15) has a simple structure. Therefore, there is no need to provide a complicated mechanism.

Furthermore, in blowing out air right below such as during heating operation, each opening cover (15) serves as a partition wall between the associated couple of air inlet (11) and air outlet (12), which prevents a short circuit that the air conditioner (1) directly takes in the air blown out.

—Modifications of Embodiment 1—

(Modification 1)

Figure 6:
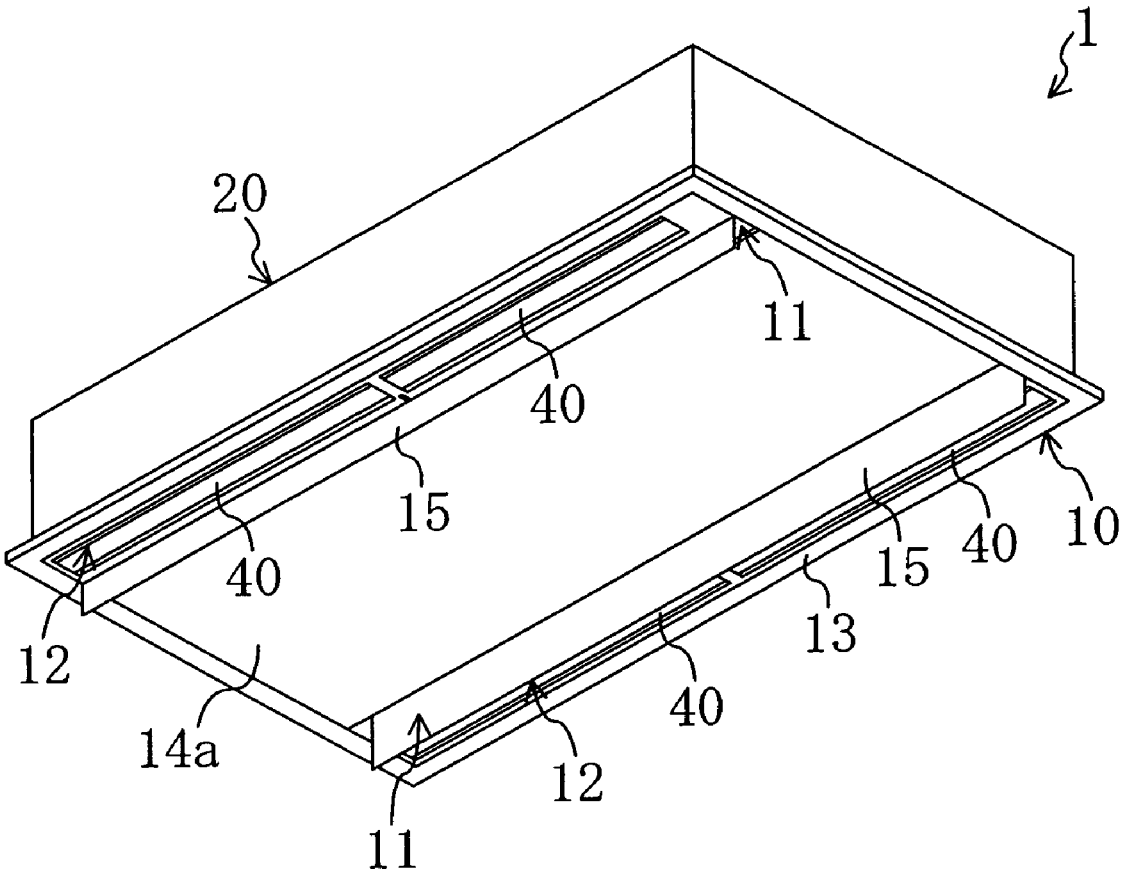
[FIG. 6]

FIG. 6 is a perspective view showing Modification 1 of Embodiment 1 and illustrates an example in which each wind direction control flap (40) is split into a plurality of (two) sections along the longitudinal direction of the air outlet (12). Although not shown in this modification, the sections of each wind direction control flap (40) are connected to their respective wind direction control motors (42). Therefore, in each air outlet (12), the sections of the wind direction control flap (40) can be individually controlled in direction.

The rest of the configuration is the same as in the example of FIGS. 1 to 5.

Also in this example of FIG. 6, when the air conditioner (1) is stopped, the entire interior panel (10) can be made flat and the structure and behavior can be prevented from being complicated.

(Modification 2)

Figure 7:
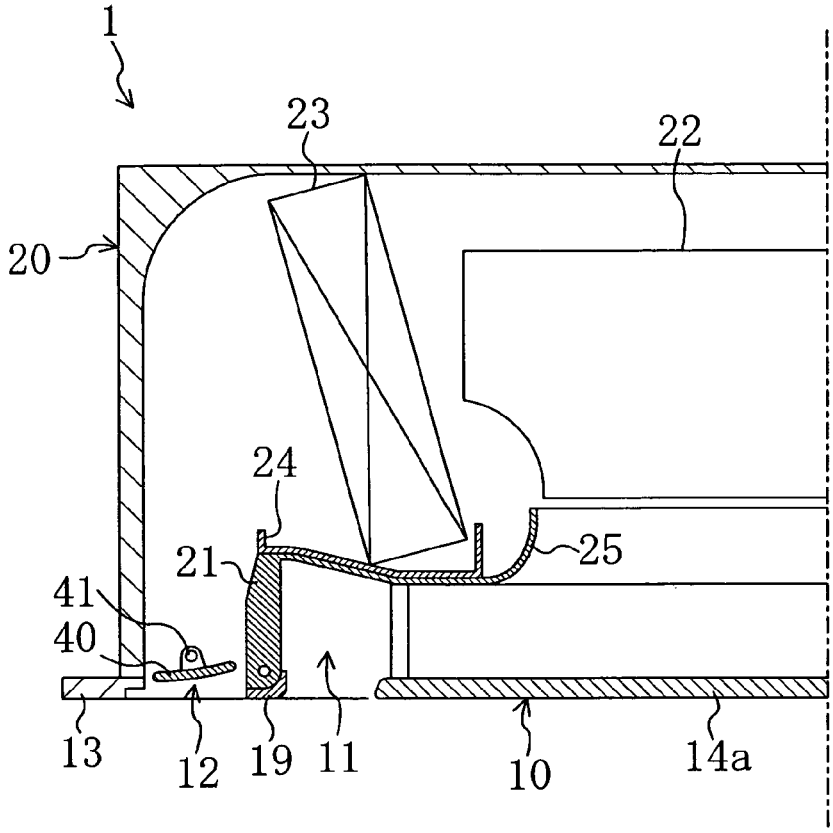
[FIG. 7]
Figure 8:
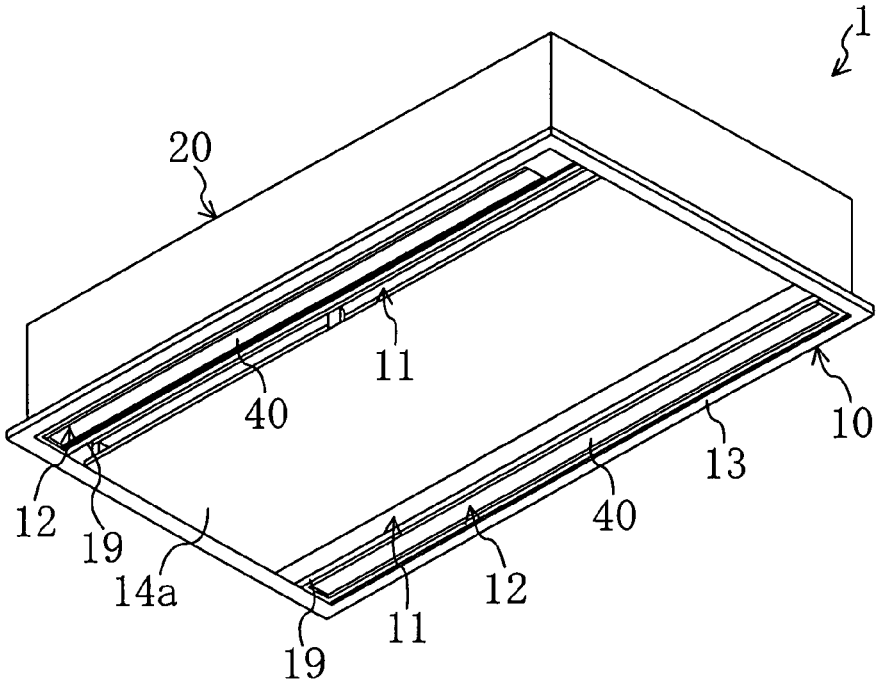
[FIG. 8]

Modification 2 shown in FIGS. 7 and 8 is an example in which, instead of the opening covers (15), rail-like partition members (19) are attached to their respective support members (21). In this case, the air inlets (11) and the air outlets (12) always appear. This cannot provide an entirely flat interior panel (10) but eliminates the need to dispose the opening covers (15) and the opening/closing mechanism (30). Therefore, use can be made as an interior panel (10) for an air conditioner (1) required to be produced at low cost. In other words, the interior panel (10) of Embodiment 1 shown in FIGS. 1 to 5 can have the same basic configuration as a low-cost interior panel (10) from which the function of providing an entirely flat surface is eliminated.

(Modification 3)

Figure 9:
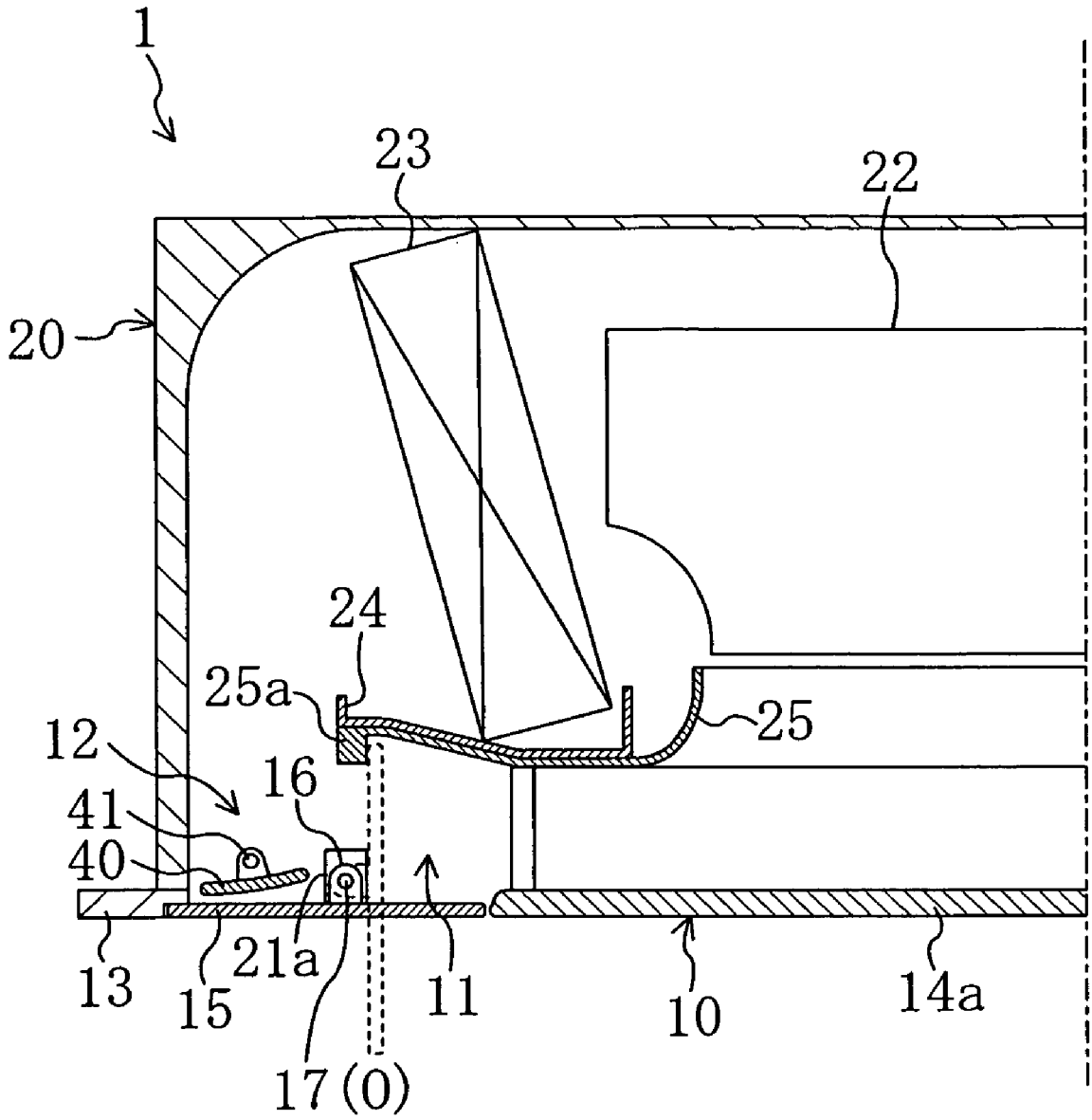
[FIG. 9]

Modification 3 shown in FIG. 9 is an example different in the support structure for each opening cover (15) from the example shown in FIG. 4. Specifically, two support members (21*a*) are disposed one at either end of each couple of openings (11, 12) in the casing (20) (at each of the upper and lower ends thereof in FIG. 3) to correspond to their respective connecting parts (16) for each opening cover (15). Each support member (21*a*) and the associated connecting part (16) are connected by a connecting pin (17).

The outside end of each bell mouth (25) (the left end thereof in the figure) extends downward but is not continued to the support member (21*a*). The outside end (25*a*) is constituted as a stopper against the turning of the opening cover (15).

Also in this configuration, when each opening cover (15) is open as shown in the broken lines, it serves as a partition member between the associated couple of air inlet (11) and air outlet (12). In other words, each couple of air inlet (11) and air outlet (12) are separated from each other by opening the associated opening cover (15).

(Modification 4)

Figure 10:
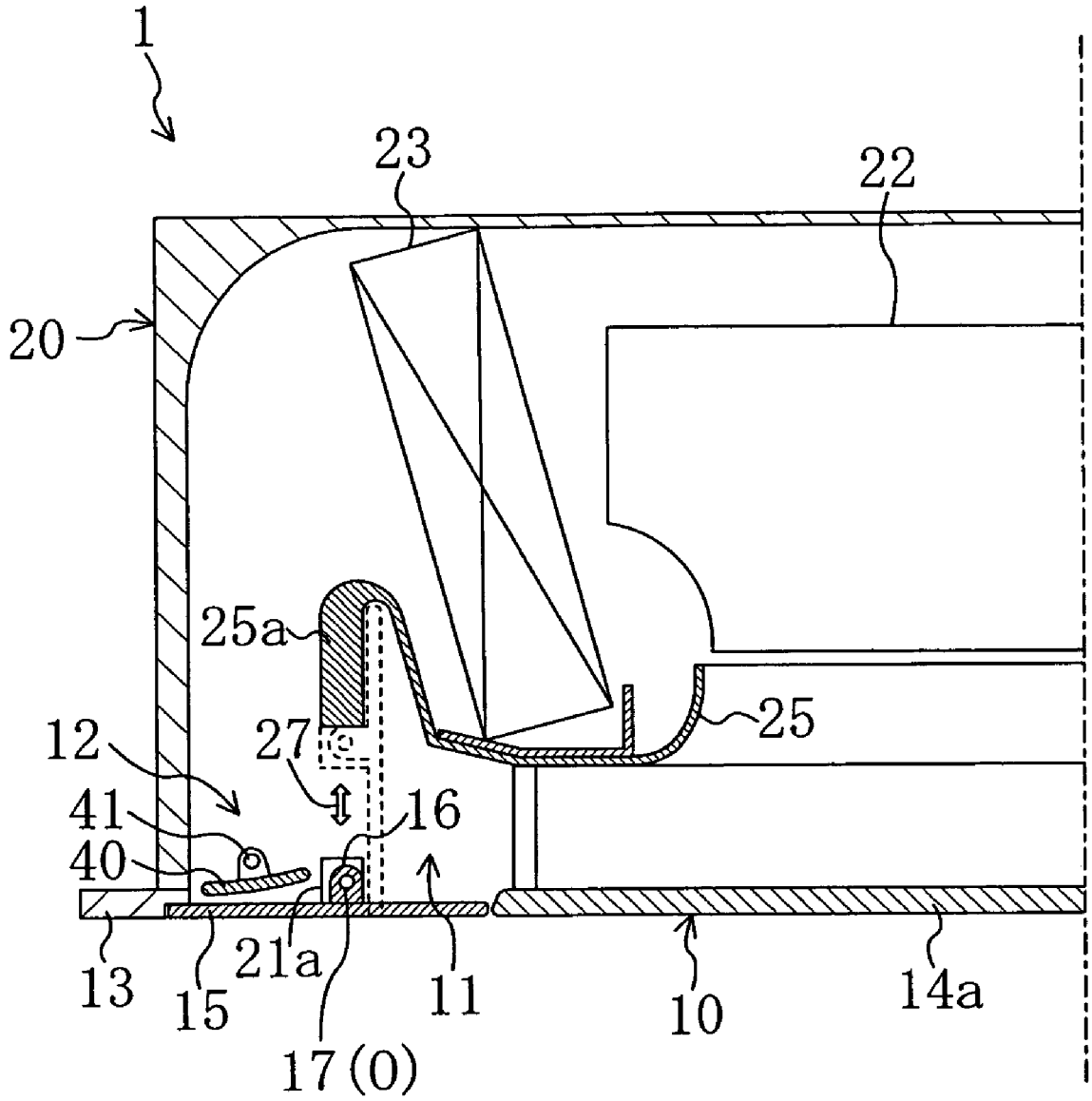
[FIG. 10]

Modification 4 shown in FIG. 10, unlike the example shown in FIG. 4, includes sliding mechanisms (27) each of which, with the associated opening cover (15) open, slides the opening cover (15) in a direction orthogonally to the panel surface so that the distal end (lower end) of the opening cover (15) is substantially flush with the panel surface. The drive system for the sliding mechanisms (27) can be appropriately selected from among any drive systems including a belt drive system and a rack-and-pinion drive system.

According to this configuration, when the opening covers (15) are open, they can be accommodated within the casing (20) without extending downward beyond the panel surface. Therefore, the air conditioner (1) can have a simpler design not only when it is stopped but also when it is in operation. Furthermore, even if the inside surfaces of the opening covers (15) are filled with brush fibers or subjected to any other measure for dew condensation prevention, this does not impair the design because the opening covers (15) do not extend beyond the panel surface.

(Modification 5)

Although the above embodiments describe examples in which the opening covers (15) turn to the angle orthogonal to the panel surface, the angle θ to which the opening covers (15) turn is, for example, 30° or more as shown in the broken lines in FIG. 4. The angle θ may be about 45° at maximum or about 60° at maximum. Furthermore, the opening covers (15) may be configured to allow stepwise or continuous angle control when they are open.

Since, thus, the opening/closing mechanism (30) is configured to allow the opening covers (15) to turn from the closed position within a predetermined range of angles, the user can select a desired angle of air supply.

<<Embodiment 2 of the Invention>>

A description is given of Embodiment 2 of the invention.

Figure 11:
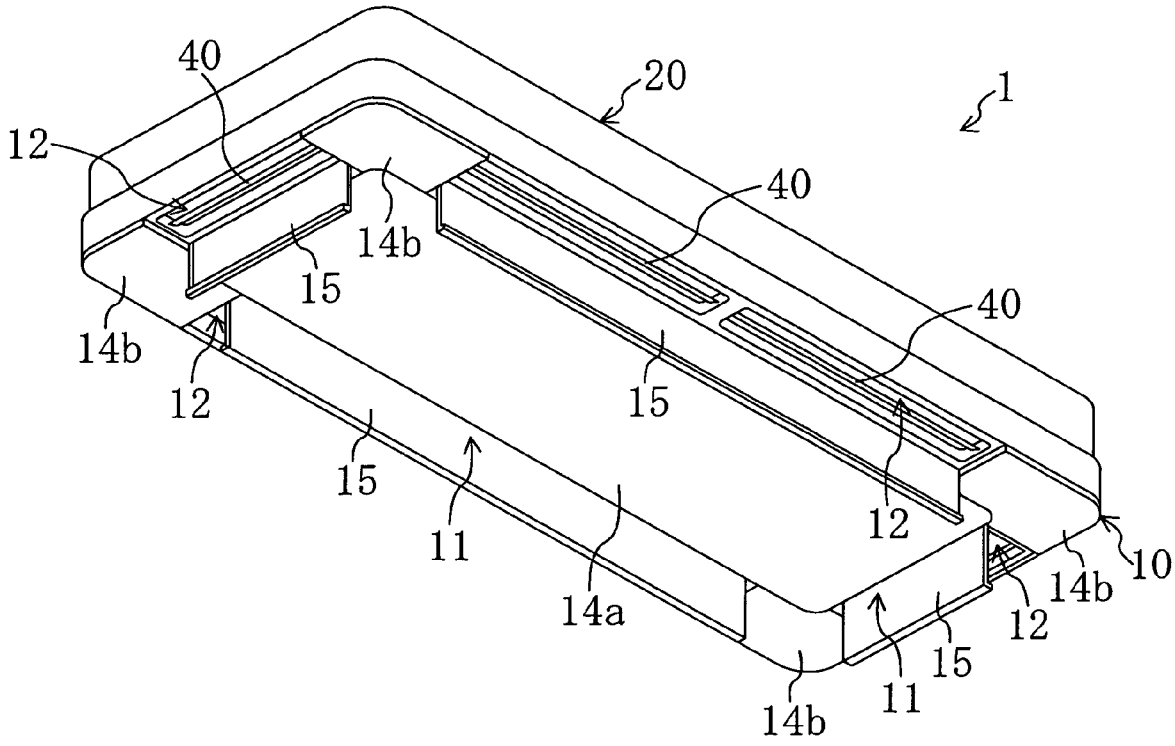
[FIG. 11]
Figure 12:
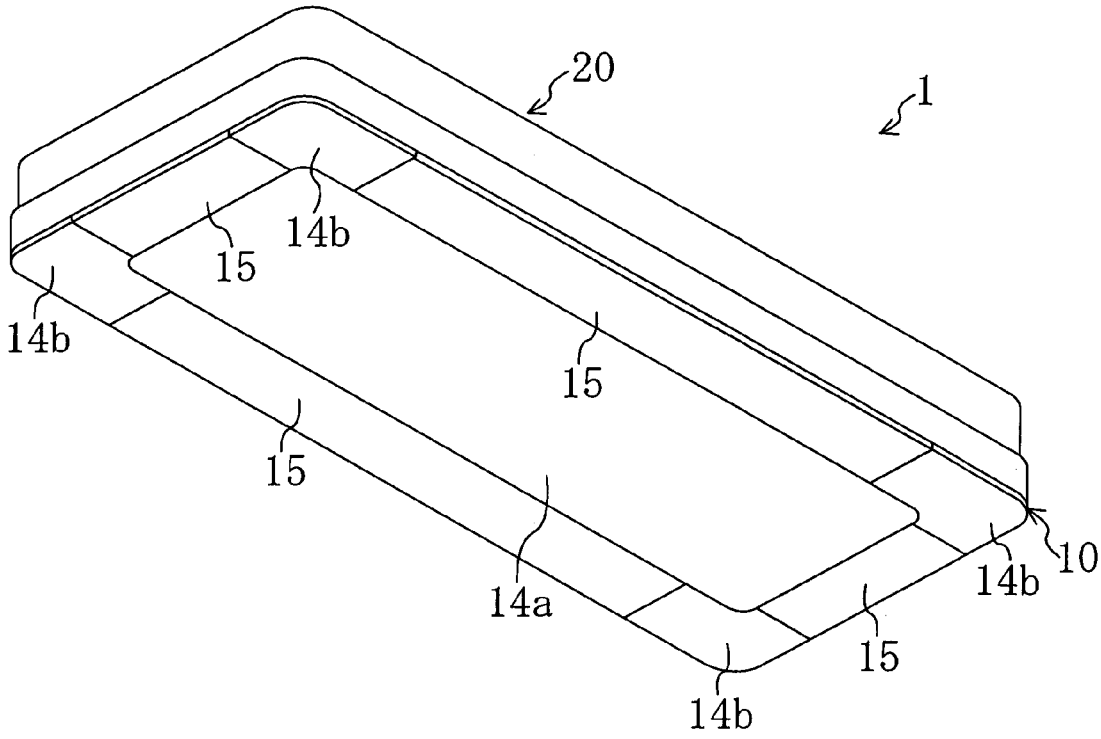
[FIG. 12]

FIGS. 11 and 12 show an application of the present invention to a four-directional air supply, ceiling pendant air conditioner (1). The example shown in FIGS. 1 to 6 describes an embodiment of an interior panel (10) in which one pair of opposed ends (long-side opposed ends) of a rectangular panel surface have their respective couples of juxtaposed air inlet (11) and air outlet (12) openings. Unlike this, in the example shown in FIGS. 11 and 12, two pairs of opposed ends (long-side opposed ends and short-side opposed ends) of a rectangular panel surface have their respective couples of juxtaposed air inlet (11) and air outlet (12) openings. In this case, although not shown, the four opening covers (15) can be driven by a single drive motor or can be driven two by each of two drive motors.

Furthermore, the interior panel (10) includes no frame (13) but includes a center plate (14*a*) and four corner plates (14*b*) constituting a rectangular flat surface together with the center plate (14*a*) and the opening covers (15) when the opening covers (15) are closed. Each of the air outlets (12) appearing with the long-side opening covers (15) open is provided with two wind direction control flaps (40). On the other hand, each of the air outlets (12) appearing with the short-side opening covers (15) open is provided with a single wind direction control flap (40).

Also in Embodiment 2, when the air conditioner (1) is stopped, the entire interior panel (10) can be made flat and the structure and behavior can be prevented from being complicated.

—Modifications of Embodiment 2—

(Modification 1)

Figure 13:
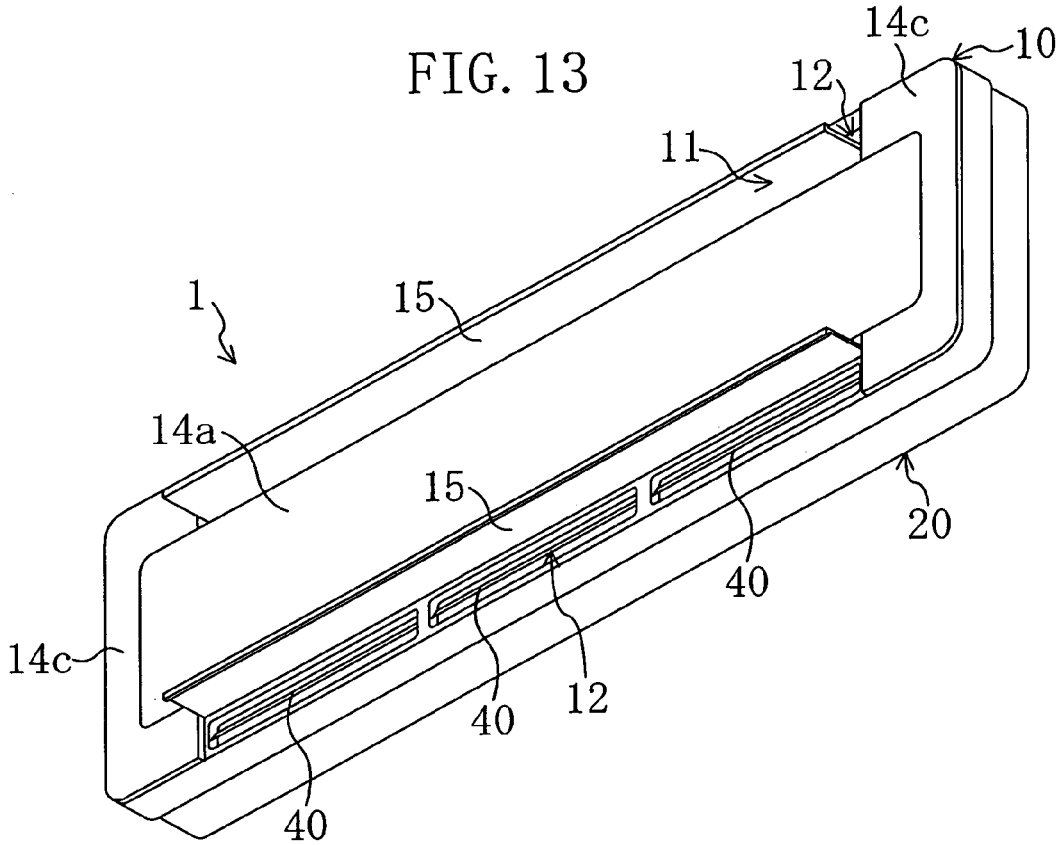
[FIG. 13]
Figure 14:
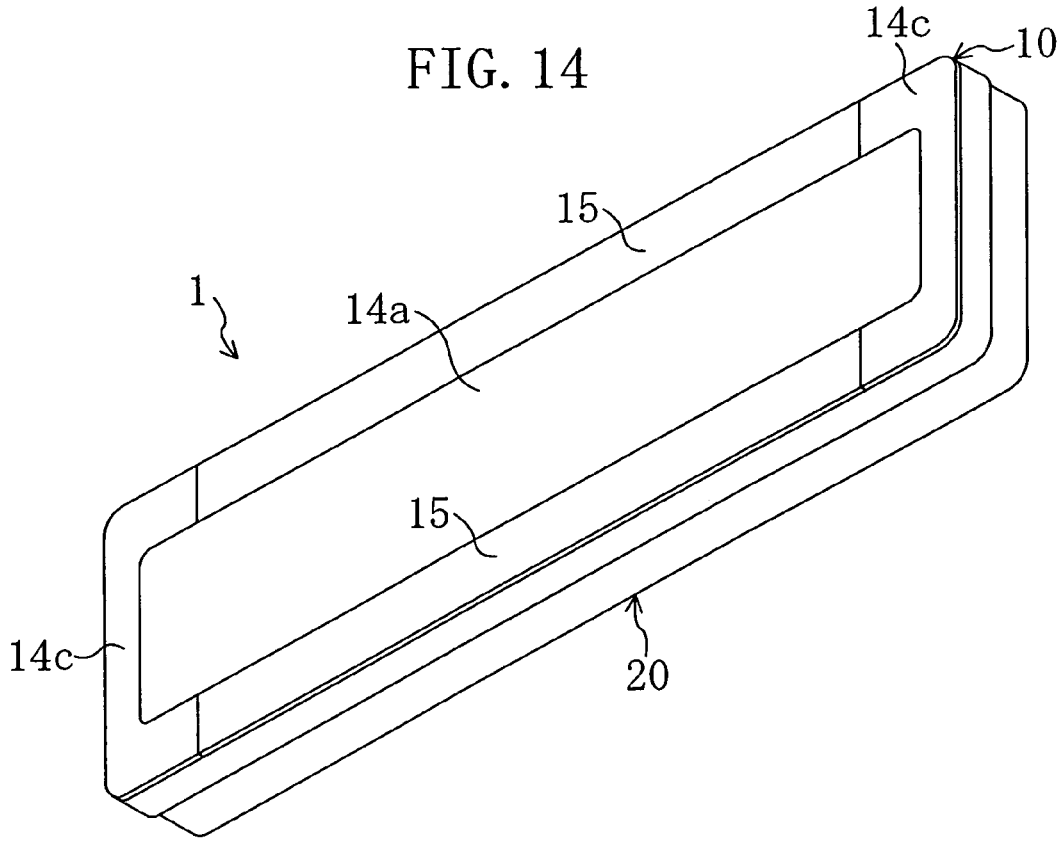
[FIG. 14]

FIGS. 13 and 14 show an application of an interior panel (10) of the present invention to an indoor unit of a wall-mounted air conditioner (1). In this example, one pair of opposed ends (long-side upper and lower opposed ends) of a rectangular panel surface have their respective couples of juxtaposed air inlet (11) and air outlet (12) openings and their respective opening covers (15). Each of the air outlets (12) appearing with the opening covers (15) open is provided with three wind direction control flaps (40). Furthermore, the interior panel (10) does not have short-side couples of air inlet (11) and air outlet (12) openings and corresponding opening covers (15), unlike the example of FIGS. 11 and 12, but includes U-shaped side plates (14*c*) instead.

Although a general wall-mounted air conditioner (1) includes a cross-flow fan in the casing (20), this embodiment instead includes a centrifugal fan (22) as in Embodiments 1 and 2 to allow air supply from upper and lower ends of the casing (20).

(Modification 2)

Figure 15:
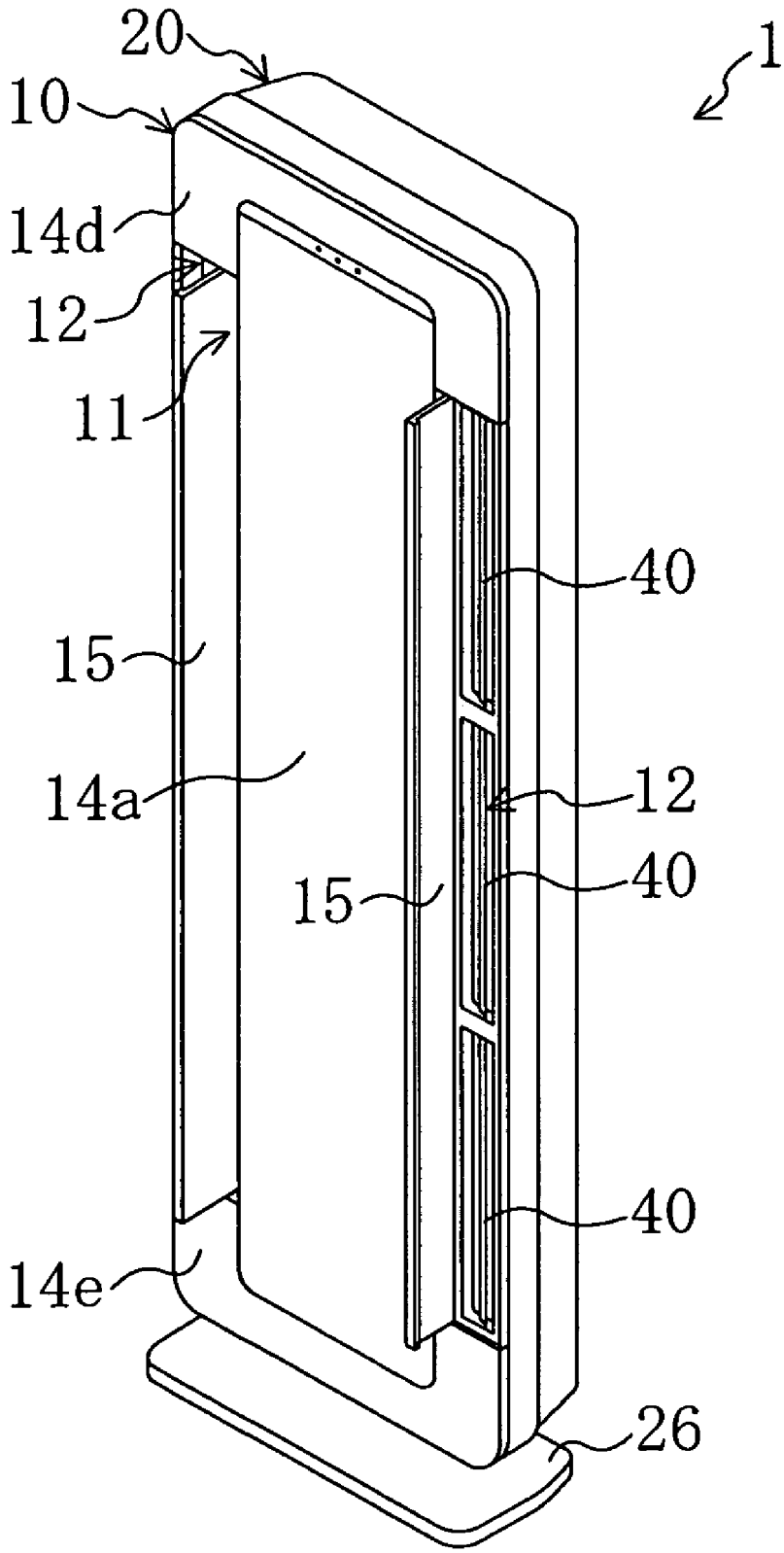
[FIG. 15]
Figure 16:
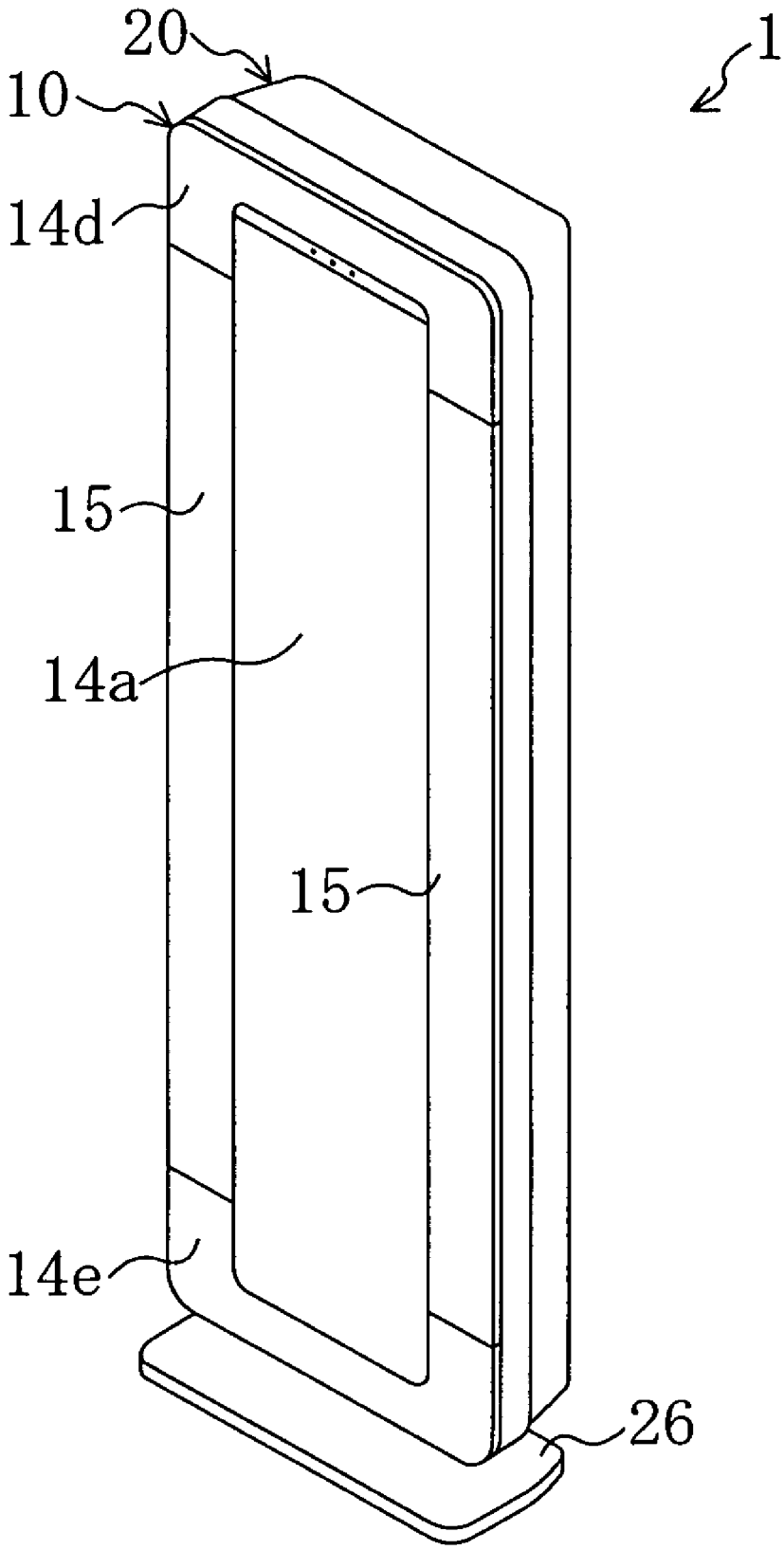
[FIG. 16]

FIGS. 15 and 16 show an application of an interior panel (10) of the present invention to an indoor unit of a floor-standing air conditioner (1). This application is an example in which the wall-mounted air conditioner (1) shown in FIGS. 13 and 14 is vertically oriented and a stand (26) is provided at the bottom of the casing (20). One of the side plates (14*c*) in the wall-mounted air conditioner (1) corresponds to a top plate (14*d*) in the floor-standing air conditioner (1), while the other corresponds to a bottom plate (14*e*) therein. The rest of the configuration is the same as in the example of FIGS. 13 and 14.

<<Other Embodiments>>

The above embodiments may have the following configurations.

Although in the above embodiments at least one pair or two pairs of opposed ends of the interior panel (10) have their respective couples of juxtaposed air inlet (11) and air outlet (12) openings, the pair of opposed ends thereof may not necessarily have their respective couples of air inlet (11) and air outlet (12) openings. For example, there may be provided a single couple of air inlet (11) and air outlet (21) openings at a single point of the interior panel (10) or three couples of air inlet (11) and air outlet (21) openings one at each of three points of the interior panel (10).

Furthermore, the shape of the interior panel (10) is not limited to quadrangle, such as rectangle, and may be any other shape. In such cases, the air inlet (11) and the air outlet (12) can be arranged at any point of the interior panel (10) so long as they are juxtaposed to each other.

Furthermore, although the above embodiments employ as the opening/closing mechanism a mechanism of turning each opening cover (15) about a central axis (O) between the associated couple of juxtaposed air inlet (11) and air outlet (12), any other opening/closing mechanism may be employed so long as it changes the position of the opening cover (15) within a region including the couple of juxtaposed air inlet (11) and air outlet (12).

The above embodiments are merely preferred embodiments in nature and are not intended to limit the scope, applications and use of the invention.

Industrial Applicability

As can be seen from the above description, the present invention is useful for an interior panel (10) for an air conditioner (1) of the type having a couple of juxtaposed air inlet (11) and air outlet (12) and useful for the air conditioner (1) therewith.

The invention claimed is:

1. An interior panel of an air conditioner in which the surface of the interior panel has a couple of juxtaposed air inlet and air outlet and an immovable center plate disposed adjacent to the air inlet, the interior panel being provided with: a single opening cover covering the couple of air inlet and air outlet together; and an opening/closing mechanism for opening and closing the couple of air inlet and air outlet by changing the position of the single opening cover within a region including the couple of air inlet and air outlet, wherein the opening/closing mechanism is a mechanism for turning the opening cover about a central axis located between the couple of air inlet and air outlet, and the immovable center plate and the single opening cover form a flat surface when the opening cover closes the couple of air inlet and air outlet.

2. The interior panel of the air conditioner according to claim 1, wherein the interior panel is provided with a fixed member disposed inwardly of the panel surface, and the opening/closing mechanism includes a drive motor fixed to the fixed member, a drive gear fixed to the drive motor, and a driven gear mounted to the single opening cover and mated with the drive gear.

3. The interior panel of the air conditioner according to claim 2, wherein the surface of the interior panel has a plurality of couples of juxtaposed air inlet and air outlet openings formed at different points and provided with their respective single opening covers, and the opening/closing mechanism includes a power transmission mechanism for transmitting power of one said drive motor to a plurality of said single opening covers.

4. The interior panel of the air conditioner according to claim 1, wherein the opening cover is configured to serve as a partition member between the couple of air inlet and air outlet when the single opening cover is open.

5. The interior panel of the air conditioner according to claim 1, wherein the interior panel is provided with a sliding mechanism that, with the single opening cover open, slides the single opening cover in a direction orthogonal to the panel surface so that the distal end of the single opening cover is substantially flush with the panel surface.

6. The interior panel of the air conditioner according to claim 1, wherein the opening/closing mechanism is configured to allow the single opening cover to turn within a predetermined range of angles with respect to a closed position of the single opening cover.

7. The interior panel of the air conditioner according to claim 1, wherein one pair of opposed ends of the panel surface of substantially quadrangular shape have their respective couples of juxtaposed air inlet and air outlet openings.

8. The interior panel of the air conditioner according to claim 1, wherein two pairs of opposed ends of the panel surface of substantially quadrangular shape have their respective couples of juxtaposed air inlet and air outlet openings.

9. The interior panel of the air conditioner according to claim 1, wherein the air outlet is provided with a wind direction control flap for controlling the angle of air supply with respect to the panel surface, and the wind direction control flap is split into a plurality of sections along the longitudinal direction of the air outlet.

10. An air conditioner in which an interior panel is fitted to an opening of a casing, the interior panel comprising the interior panel according to claim 1.

* * * * *